US009996044B2

(12) United States Patent
Yada

(10) Patent No.: US 9,996,044 B2
(45) Date of Patent: Jun. 12, 2018

(54) IMAGE FORMING APPARATUS CAPABLE OF PERFORMING POWER SUPPLY CONTROL FOR STARTING UP HEATER

(71) Applicant: BROTHER KOGYO KABUSHIKI KAISHA, Nagoya-shi, Aichi-ken (JP)

(72) Inventor: Naoya Yada, Kuwana (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days. days.

(21) Appl. No.: 15/441,605

(22) Filed: Feb. 24, 2017

(65) Prior Publication Data

US 2017/0248894 A1 Aug. 31, 2017

(30) Foreign Application Priority Data

Feb. 29, 2016 (JP) ..... 2016-037672

(51) Int. Cl.
*G03G 15/00* (2006.01)
*G03G 15/20* (2006.01)

(52) U.S. Cl.
CPC ..... *G03G 15/80* (2013.01); *G03G 15/2039* (2013.01); *G03G 15/2053* (2013.01)

(58) Field of Classification Search
CPC ..... G03G 15/80
USPC ..... 399/67
See application file for complete search history.

(56) References Cited

FOREIGN PATENT DOCUMENTS

| | | | | |
|---|---|---|---|---|
| JP | 02059782 A | * | 2/1990 | |
| JP | 11-202680 A | | 7/1999 | |
| JP | 2008-276181 A | | 11/2008 | |
| JP | 2012-233981 A | | 11/2012 | |
| JP | 2013097691 A | * | 5/2013 | ..... G03G 15/80 |
| JP | 2015-111204 A | | 6/2015 | |

* cited by examiner

*Primary Examiner* — Quana M Grainger
(74) *Attorney, Agent, or Firm* — Merchant & Gould P.C.

(57) ABSTRACT

An image forming apparatus includes a process unit, a controller, and a fixing unit including a heater. The process unit is configured to form a developer image on a sheet. The heater is configured to be applied with an AC voltage, and to heat the sheet to thereby fix the developer image to the sheet. The controller is configured to perform: executing a continuous supply control in which the heater is continuously energized; acquiring an initial voltage dropping level of the AC voltage and a recovery time during the executing the continuous supply control; and setting a power supply control to control energization of the heater for starting up the heater on the basis of the acquired initial voltage dropping level and the acquired recovery time.

20 Claims, 10 Drawing Sheets

IMAGE FORMING APPARATUS CAPABLE OF PERFORMING POWER SUPPLY CONTROL FOR STARTING UP HEATER

CROSS REFERENCE TO RELATED APPLICATION

This application claims priority from Japanese Patent Application No. 2016-037672 filed Feb. 29, 2016. The entire content of the priority application is incorporated herein by reference.

TECHNICAL FIELD

The present disclosure relates to an image forming apparatus capable of suppressing influence adversely exerted upon the AC power source connected to the apparatus, and also to a method for controlling the apparatus to suppress such influence.

BACKGROUND

An electro-photographic image forming apparatus provided with a heater for thermally fixing developer images is well known in the art. To thermally fix the developer image, the heater heats a sheet of paper onto which a developer image has been transferred. Since large power is required for the heater to operate, large inrush current abruptly flows into the heater from a power source connected to the image forming apparatus when the heater is started up. This large inrush current may cause a power source voltage (i.e., a voltage level of the power source) to be lowered or dropped. This voltage dropping of the power source voltage adversely exerts influence not only upon operation of the image forming apparatus but also upon operations of other apparatuses connected to the same power source.

Japanese Patent Application Publication No. H11-202680 discloses an image forming apparatus provided with a thermally fixing heater. The disclosed apparatus performs a phase control when starting up the heater, thereby restraining a power source voltage from being abruptly dropped.

SUMMARY

Performance capability of the power source differs depending on the environment under which the image forming apparatus is used. For example, the performance capability of the power source differs among countries, geographical regions, and power source systems provided by facilities. Accordingly, in the above-described image forming apparatus in which the phase control is always performed to gradually increase current flowing into the heater, this control may cause unnecessary delay in starting up the heater if the apparatus is used under an environment in which the power source has a sufficient performance capability.

It is an object of the present disclosure to provide an image forming apparatus capable of appropriately controlling power supply to the heater in accordance with an environment in which the apparatus is used.

In order to attain the above and other objects, according to one aspect, the disclosure provides an image forming apparatus including a process unit, a fixing unit, and a controller. The process unit is configured to form a developer image on a sheet. The fixing unit includes a heater. The heater is configured to be applied with an AC voltage and to heat the sheet to fix the developer image to the sheet. The controller is configured to perform: executing a continuous supply control in which the heater is continuously energized; acquiring an initial voltage dropping level of the AC voltage and a recovery time during the executing the continuous supply control, the initial voltage dropping level being a voltage dropping level from a regular voltage level in an initial cycle of the AC voltage after the executing the continuous supply control is started, the recovery time being a time period of recovering the AC voltage to recover to the regular voltage level from a voltage level dropped owing to the executing the continuous supply control; and setting a power supply control to control energization of the heater for starting up the heater on the basis of the acquired initial voltage dropping level and the acquired recovery time.

According to another aspect, the disclosure provides an image forming apparatus includes a process unit, a fixing unit, and a controller. The process unit is configured to form a developer image on a sheet. The fixing unit includes a heater. The heater is configured to be applied with an AC voltage and to heat the sheet to fix the developer image to the sheet. The controller is configured to perform: executing a continuous supply control in which the heater is continuously energized; and setting a power supply control to control energization of the heater for starting up the heater on the basis of: a first zero-cross time width acquired when the heater is deenergized; a second zero-cross time width acquired immediately after the executing the continuous supply control is started; and a time duration from a timing when the executing the continuous supply control is started to a timing when a difference value becomes equal to or lower than a prescribed value. The difference value is obtained by subtracting an (m+n)-th zero-cross time width after the executing the continuous supply control is started from an m-th zero-cross time width after the executing the continuous supply control is started.

According to still another aspect, the disclosure provides a method for controlling an image forming apparatus. The image forming apparatus includes a process unit and a fixing unit including a heater. The process unit is configured to form a developer image on a sheet. The heater is configured to be applied with an AC voltage and to heat the sheet to fix the developer image to the sheet. The method includes: executing a continuous supply control in which the heater is continuously energized; acquiring an initial voltage dropping level of the AC voltage and a recovery time during the continuous supply control, the initial voltage dropping level being a voltage dropping level from a regular voltage level in an initial cycle of the AC voltage after the executing the continuous supply control is started, the recovery time being a time period of recovering the AC voltage to the regular voltage level from a voltage level dropped owing to the executing the continuous supply control; and setting, on the basis of the acquired initial voltage dropping level and the acquired recovery time, a power supply control to control energization of the heater for starting up the heater.

BRIEF DESCRIPTION OF THE DRAWINGS

The particular features and advantages of the disclosure will become apparent from the following description taken in connection with the accompanying drawings, in which.

DETAILED DESCRIPTION

Next, a laser printer 1 as an image forming apparatus according to an embodiment will be described with reference to the accompanying drawings.

Figure 1:
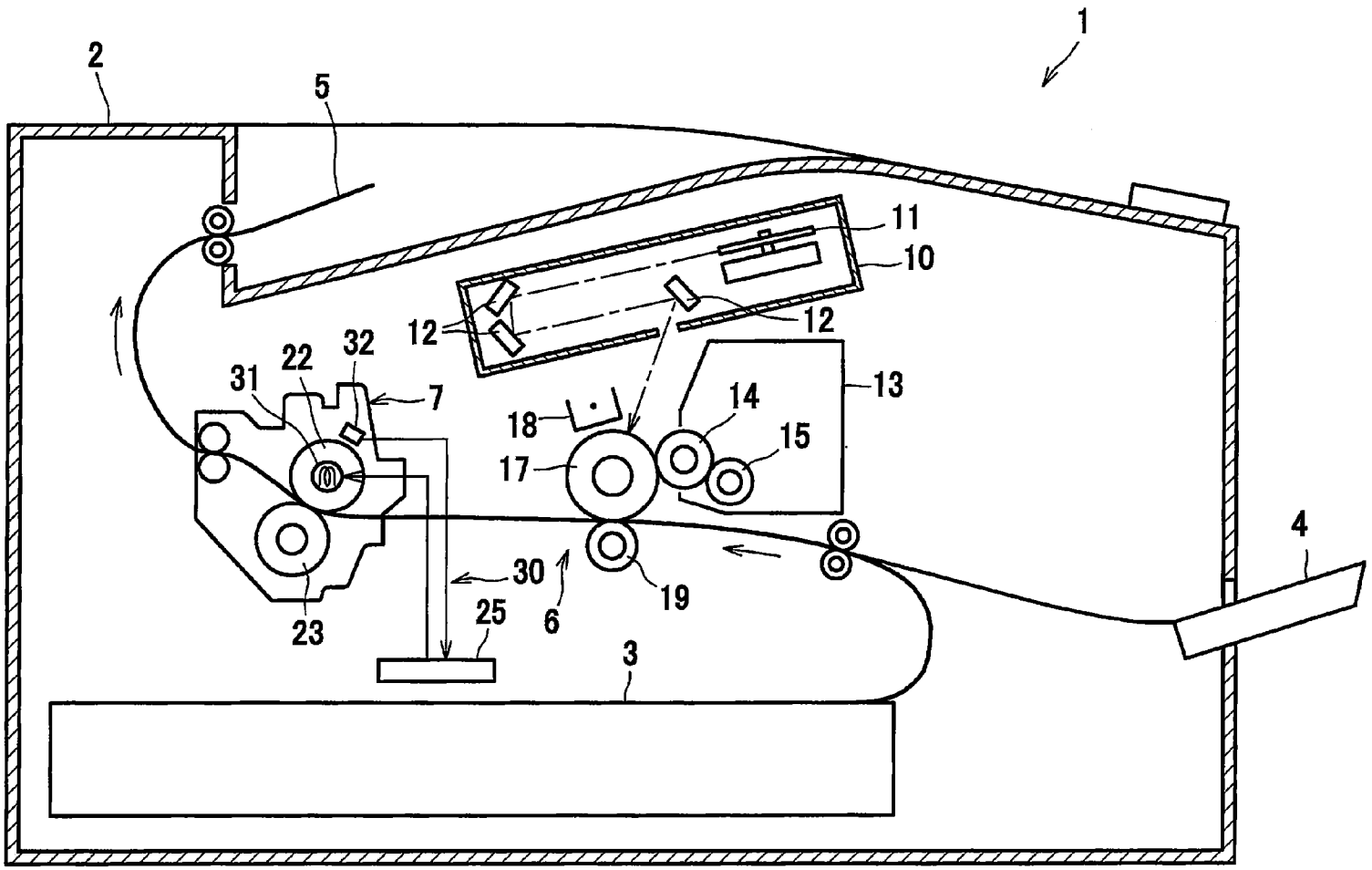
FIG. 1 is a cross-sectional view of an image forming apparatus according to one embodiment.

The laser printer 1 is configured to form an image on a sheet of paper 5. As illustrated in FIG. 1, the laser printer 1 is provided with a main body casing 2, a sheet feeding tray 3, a manual insert tray 4, a process unit 6, and a fixing unit 7. The main body casing 2 accommodates therein the sheet feeding tray 3, a part of the manual insert tray 4, the process unit 6, and the fixing unit 7. The sheet of paper 5 is inserted from the selected one of the sheet feeding tray 3 and the manual insert tray 4, and is conveyed in a conveyance direction indicated by arrows depicted in FIG. 1. The sheet of paper 5 is discharged outside the laser printer 1 through the process unit 6 and the fixing unit 7. The sheet of paper 5 is an example of the claimed "sheet."

The process unit 6 is configured to form a developer image on the sheet of paper 5, and includes a scanner 10, a developing cartridge 13, a photosensitive drum 17, a charger 18, and a transfer roller 19.

The scanner 10 is internally disposed at the top of the main body casing 2, and includes a laser beam emission portion (not illustrated), a polygon mirror 11, a plurality of reflection mirrors 12, and a plurality of lenses (not illustrated). As indicated by a chain line depicted in FIG. 1, in the scanner 10 the laser beam emission portion emits a laser beam toward the photosensitive drum 17 through the polygon mirror 11, the plurality of reflection mirrors 12, and the plurality of lenses. The emitted laser beam thus scans a surface of the photosensitive drum 17.

The developing cartridge 13 accommodates toner therein, and is provided with a developing roller 14 and a supply roller 15. The developing roller 14 is disposed in facing relation to the photosensitive drum 17. The supply roller 15 is configured to supply the toner to the developing roller 14. The toner in the developing cartridge 13 is supplied to the developing roller 14 through rotation of the supply roller 15. The toner supplied from the supply roller 15 is carried by the developing roller 14.

The charger 18 is disposed above the photosensitive drum 17 and is spaced apart therefrom. The transfer roller 19 is disposed below and in facing relation to the photosensitive drum 17.

The photosensitive drum 17 is uniformly charged to, for example, positive polarity by the charger 18 while the photosensitive drum 17 is rotating. Then, the laser beam emitted from the scanner 10 is irradiated onto the surface of the photosensitive drum 17 to expose the same to light, thereby forming an electrostatic latent image on the surface of the photosensitive drum 17. After that, the toner is supplied to the electrostatic latent image on the surface of the photosensitive drum 17 from developing roller 14, so that electrostatic latent image becomes a visible developer image.

The developer image carried on the surface of the photosensitive drum 17 is transferred to the sheet of paper 5 when the same is conveyed through a position between the photosensitive drum 17 and the transfer roller 19 while the surface of the transfer roller 19 is applied with transfer bias.

The fixing unit 7 is disposed downstream of the process unit 6 in the conveyance direction of the sheet of paper 5. The fixing unit 7 includes a fixing roller 22 and a pressure roller 23 pressed thereagainst. The fixing roller 22 has a hollow cylindrical shaped roller and a heater 31 disposed therein. For example, an electrically resistive heating body generating heat, such as a halogen heater or a ceramic heater, can be employed as the heater 31.

The heater 31 is connected to a circuit board 25, and is applied with an AC voltage thereby. The AC voltage applied to the heater 31 is controlled by an application specific integrated circuit 60 (which will be referred to as "ASIC 60" hereinafter) mounted on the circuit board 25 on the basis of a temperature of the fixing roller 22, an environment under which the laser printer 1 is used (i.e., a power source which the laser printer 1 uses), and the like. In the present embodiment, the power source which the laser printer 1 uses is an external AC power source P (see FIG. 2). In the fixing unit 7, the sheet of paper 5 is heated by the heater 31 accommodated in the pressure roller 23 while the sheet of paper 5 is nipped between the fixing roller 22 and the pressure roller 23. As a result, the developer image is thermally fixed on the sheet of paper 5.

Figure 2:
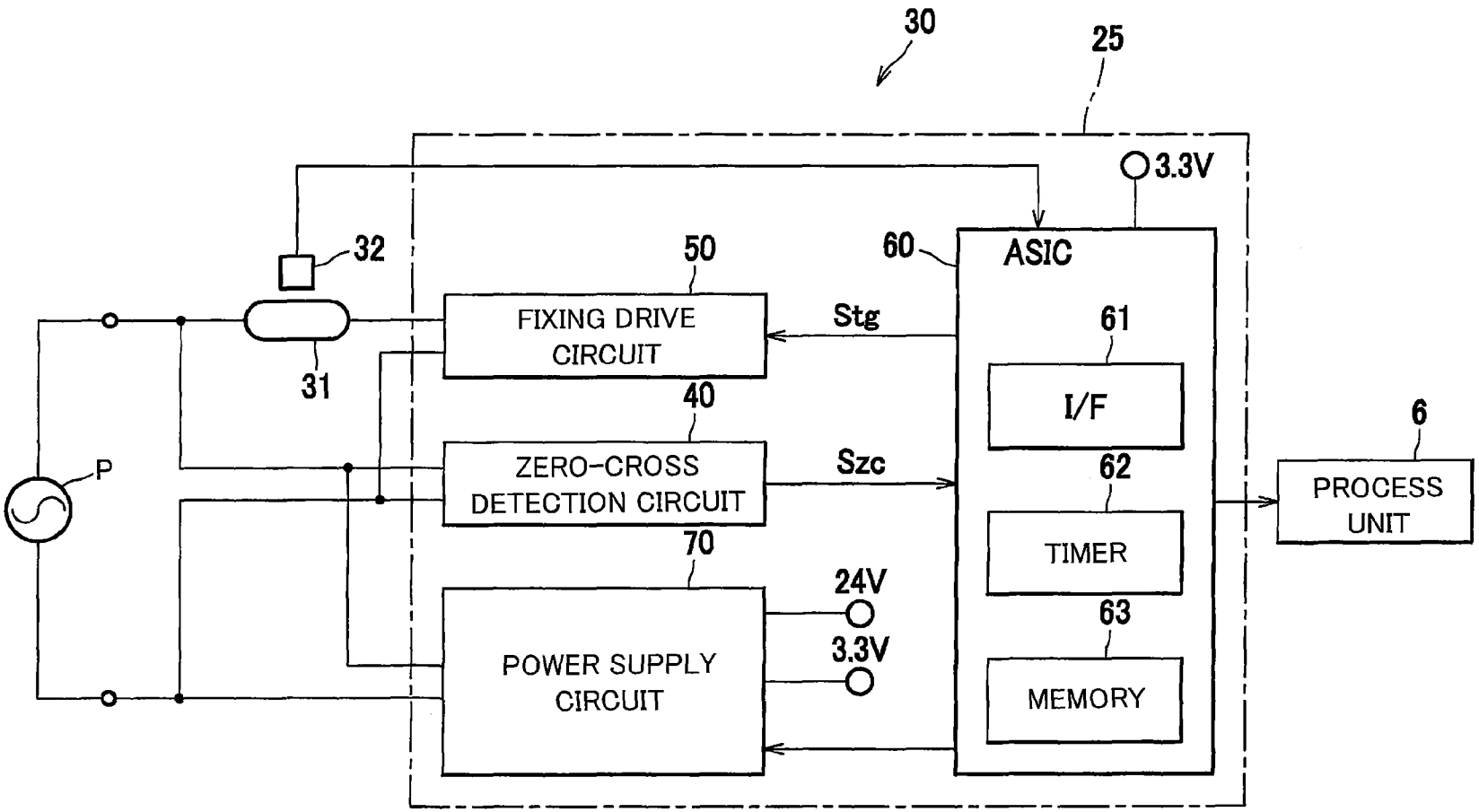
FIG. 2 is a block diagram illustrating a configuration of a heating unit of the image forming apparatus according to the embodiment.

Next, a heating unit 30 will be described while referring to FIG. 2. As illustrated in FIG. 2, the heating unit 30 includes the heater 31, the circuit board 25, a thermistor 32, a zero-cross detection circuit 40, a fixing drive circuit 50, the ASIC 60, and a power supply circuit 70.

The circuit board 25 may be constituted by a single substrate. Alternatively, it may be constituted by a plurality of substrates independent from one another. The zero-cross detection circuit 40, the fixing drive circuit 50, the ASIC 60, and the power supply circuit 70 are mounted on the circuit board 25.

The heater 31 has a rated voltage of AC 115V (effective value), a rated power of 850 W, and a rated current of 7.4 A, for example.

The thermistor 32 is disposed adjacent to the fixing roller 22. The thermistor 32 is configured to detect the temperature of the fixing roller 22, and output the detection result to the ASIC 60. That is, the detected temperature of the fixing roller 22 is outputted to the ASIC 60.

Figure 3:
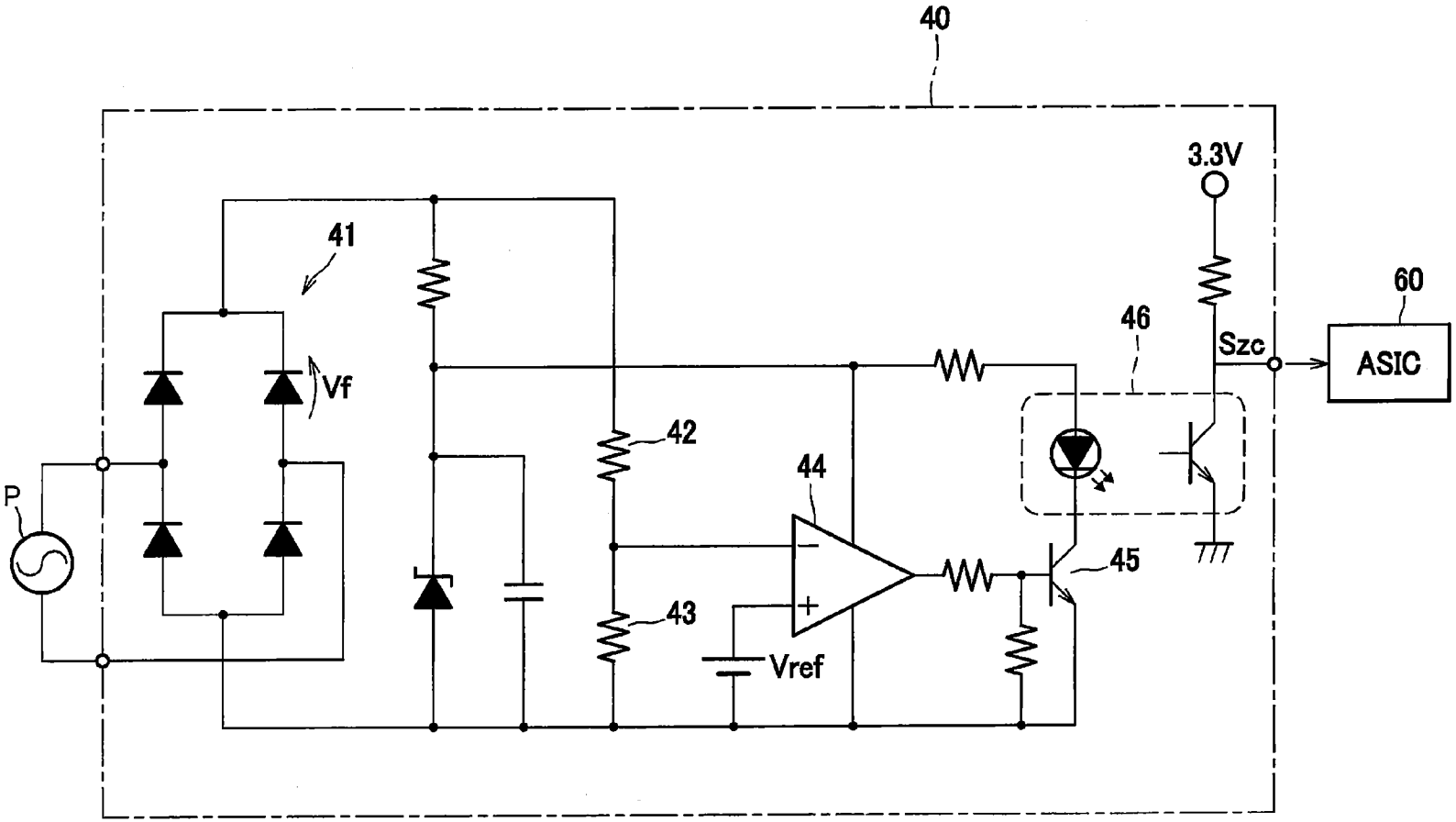
FIG. 3 is a block diagram illustrating a configuration of a zero-cross detection circuit of the image forming apparatus according to the embodiment.

The zero-cross detection circuit 40 is configured to generate a zero-cross signal Szc in relation to a zero-cross point (i.e., a zero-cross timing) of the external AC power source P, and to output the zero-cross signal Szc to the ASIC 60. As illustrated in FIG. 3, for example, the zero-cross detection circuit 40 includes a full-wave rectifier circuit 41, voltage-dividing resistors 42 and 43, a reference voltage generating section which generates a reference voltage Vref, a comparator 44, a driving transistor 45, and a photocoupler 46.

An AC voltage applied from the AC power source P is converted by the full-wave rectifier circuit 41 into a pulsating DC voltage, which is equal to or higher than the ground voltage of the zero-cross detection circuit 40. The pulsating DC voltage obtained through the conversion of the AC voltage is divided (or stepped down) by the voltage-dividing resistors 42 and 43, and this divided DC voltage is compared with the reference voltage Vref by the comparator 44. The latter outputs a signal according to the comparison result to the driving transistor 45.

The reference voltage Vref is a fixed voltage used as a threshold value for determining whether or not the AC voltage of the AC power source P approaches to 0V (i.e., the zero-cross point). Hereinafter, the AC voltage of the AC power source P will be simply referred to as "AC input voltage."

For a period of time during which the divided DC voltage is higher than the reference voltage Vref, i.e., for a period of time during which the AC input voltage has not yet approached to 0V, the output of the comparator 44 is "low" and thus the driving transistor 45 is OFF. Hence, during this period of time, the photocoupler 46 is disabled or in its OFF state (i.e., the phototransistor of the photocoupler 46 is in its OFF state) and therefore the zero-cross signal Szc outputted to the ASIC 60 is "high" (see a period K1 depicted in FIG. 5).

On the other hand, for a period of time during which the divided DC voltage is no higher than the reference voltage Vref, i.e., for a period of time during which the AC input voltage has fallen into a 0V proximity range, the output of the comparator 44 is "high" and thus the driving transistor 45 is in its ON state. Hence, during this period of time, the photocoupler 46 is enabled or in its ON state (i.e., the phototransistor of the photocoupler 46 is rendered ON) and therefore the zero-cross signal Szc outputted to the ASIC 60 is "low" (see a period K2 depicted in FIG. 5).

Figure 4:
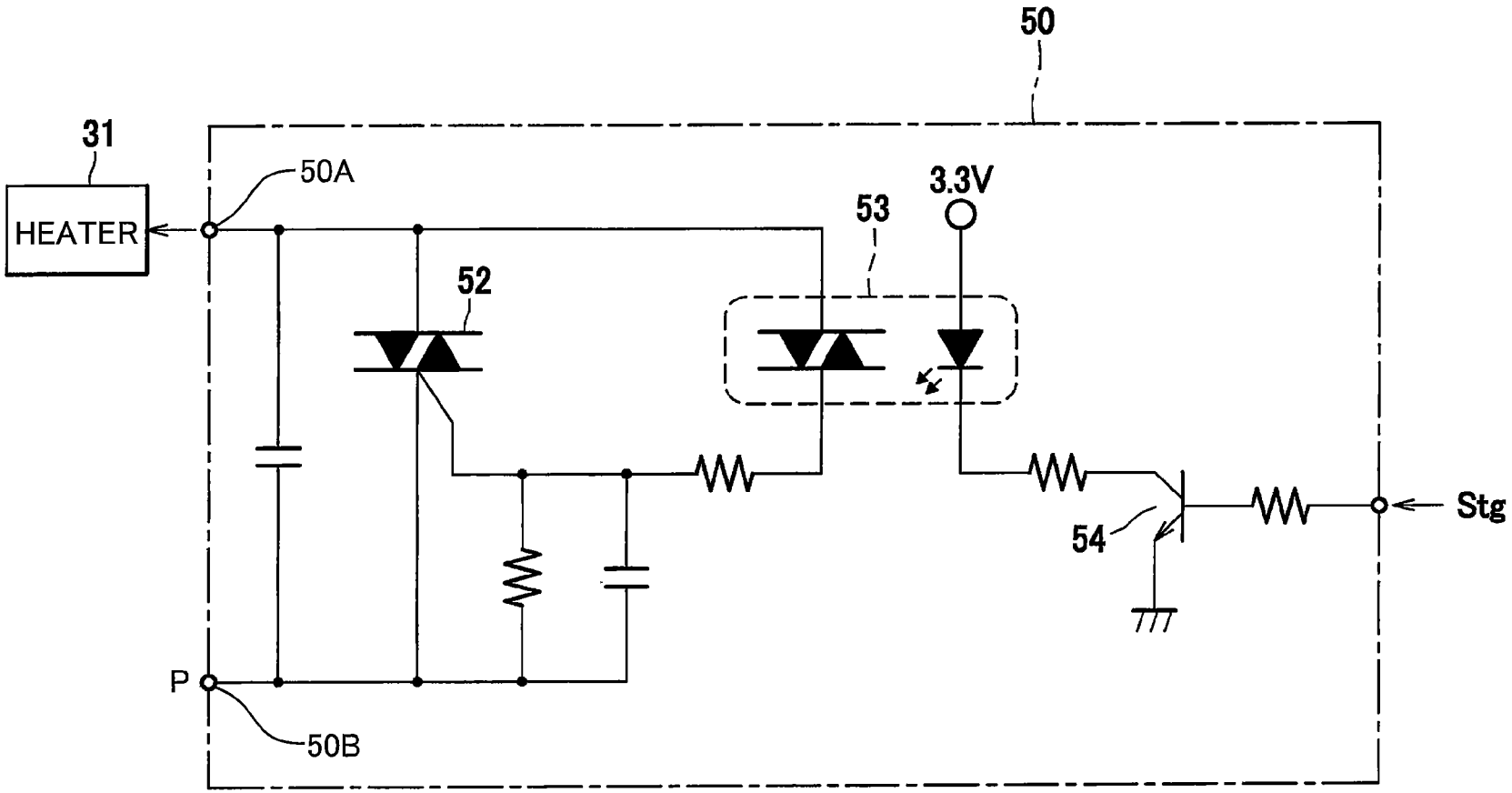
FIG. 4 is a block diagram illustrating a configuration of a fixing drive circuit of the image forming apparatus according to the embodiment.

The fixing drive circuit 50 is configured to adjust, on the basis of the zero-cross signal Szc, a time duration for which the heater 31 is energized by the AC power source P. Hereinafter, this time duration will be referred to as "energizing period." As illustrated in FIG. 4, for example, the fixing drive circuit 50 includes a triac 52, a phototriac coupler 53, and a driving transistor 54.

The driving transistor 54 is rendered ON in response to a trigger signal Stg, thereby resulting in the phototriac coupler 53 being turned on (i.e., the phototriac of the phototriac coupler 53 being turned on). That is, the phototriac coupler 53 is brought into its ON state when the trigger signal Stg inputted to the driving transistor 54 is changed from "low" to "high". The trigger signal Stg is generated (i.e., changed from "low" to "high") on the basis of a timing when the zero-cross signal Szc is changed from "high" to "low".

Figure 5:
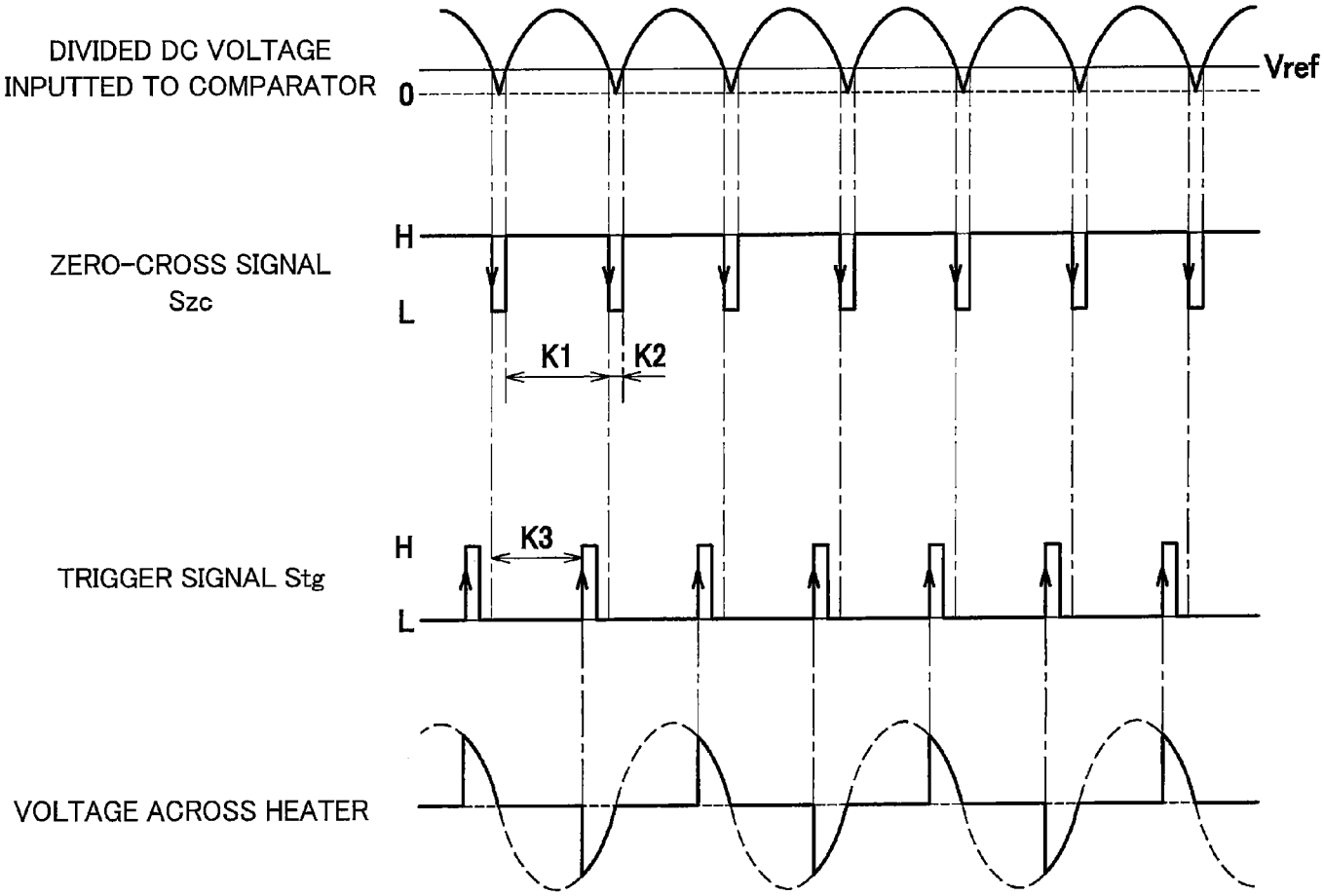
FIG. 5 is a timing chart of a voltage inputted to a comparator, a zero-cross signal, trigger signal, and a voltage across a heater.

The triac 52 is configured to adjust the energizing period. The triac 52, a fixing rely (not illustrated), and the AC power source P are connected in series. The triac 52 is turned on when the phototriac coupler 53 is rendered ON, thereby energizing the heater 31. As illustrated in FIG. 5, the energizing period starts at a timing when the trigger signal Stg is changed from "low" to "high" and ends at the zero-cross timing of the AC power source P (i.e., from a timing when energization to the heater 31 is started to a timing when the AC input voltage becomes 0V).

A temperature control with respect to the fixing unit 7 is performed by changing the energizing period. Specifically, the temperature control is carried out by changing the period of time from a timing when the zero-cross signal Szc is changed from "high" to "low" to a timing when the trigger signal Stg is switched from "low" to "high" (i.e., the period K3 illustrated in FIG. 5). Note that the connection relationship between the heater 31 and the triac 52 in relation to the AC power source P is not limited to that illustrated in FIGS. 2 and 4. That is, in the present embodiment, the heater 31 is connected between the AC power source P and the first terminal 50A of the fixing drive circuit 50, as illustrated in FIG. 4. Alternatively, the heater 31 may be connected between the AC power source P and the second terminal 50B of the fixing drive circuit 50.

Referring back to FIG. 2, the power supply circuit 70 is configured to rectify and smooth the AC input voltage to generate, for example, a DC +24V and a DC +3.3V.

The ASIC 60 includes an interface (I/F) 61, a timer 62, and a memory 63. The ASIC 60 is configured to detect the zero-cross point (i.e., the zero-cross timing) of the AC power source P on the basis of the zero-cross signal Szc inputted from the zero-cross detection circuit 40, and also to control energization of the fixing unit 7 on the basis of both the temperature detected by the thermistor 32 and the zero-cross signal Szc.

The timer 62 is used for time measurement. For example, the timer 62 is used to measure time when detecting the zero-cross point of the AC power source P. The memory 63 includes a ROM in which various programs (including a program for performing a power supply control described later) executed by the ASIC are stored, and a RAM used for temporarily storing various data while the programs are executed.

Next, the power supply control with respect the heater 31 will be described. The ASIC 60 executes the program (i.e., the program for performing the power supply control) stored in the ROM to thereby perform the power supply control.

The ASIC 60 performs an ascertaining process to ascertain a status (i.e., a performance capability) of the AC power source P at a proper timing after a power plug of a power cable of the laser printer 1 is connected to the AC power source P. The ASIC 60 sets a power supply mode suitable for the AC power source P on the basis of the ascertained status. The power supply mode is used when starting up the heater 31, and defines a power supply control for starting up the same. In the present embodiment, the power supply mode is constituted by a combination of a plurality of power supply controls. Note that detailed descriptions of the power supply mode and the power supply control will be made later.

In the present disclosure, "starting up the heater 31" or "the heater 31 is started up" means that energization of the heater 31 is commenced in a state where the heater 31 is still not preheated and the temperature of the fixing unit 7 is no higher than a predetermined temperature.

In the present embodiment, when a printing job is inputted for the first time after the laser printer 1 is switched on, the ASIC 60 performs the setting of the power supply mode. The timing when the ASIC 60 performs the setting of the power supply mode is not limited to the above timing. For example, the ASIC 60 may perform the setting of the power supply mode when the power plug of the laser printer 1 is connected to the AC power source P. Alternatively, the ASIC 60 may perform the setting of the power supply mode when the laser printer 1 is switched on.

The ASIC 60 performs a continuous supply control. The continuous supply control is a control to continuously apply the AC input voltage to the heater 31 from the AC power source P without interruption for a predetermined time period, i.e., a control to continuously energize the heater 31 for the predetermined time period. Further, after starting the continuous supply control, the ASIC 60 acquires an initial voltage dropping level (an initial voltage lowering amount) and a recovery time RT. The ASIC 60 then sets, on the basis of the acquired initial voltage dropping level and the acquired recovery time RT, the power supply mode for the time when the heater 31 is started up.

The initial voltage dropping level is a voltage dropping level from a regular voltage level of the AC input voltage in an initial cycle thereof immediately after the continuous control to continuously energize the heater 31 is started. In other words, the initial voltage dropping level is an amount of an initial voltage lowering from the regular voltage level of the AC input voltage. The initial voltage lowering is a voltage lowering of the AC input voltage in the initial cycle thereof immediately after the continuous control to continuously energize the heater 31 is started. The initial voltage dropping level is acquired by comparing a zero-cross time width $ZC_1$ with a reference zero-cross time width $ZC_0$ of the AC input voltage. Specifically, the initial voltage dropping level is equivalent to or corresponds to an indication value obtained by subtracting the reference zero-cross time width $ZC_0$ from the zero-cross time width $ZC_1$.

Figure 6:
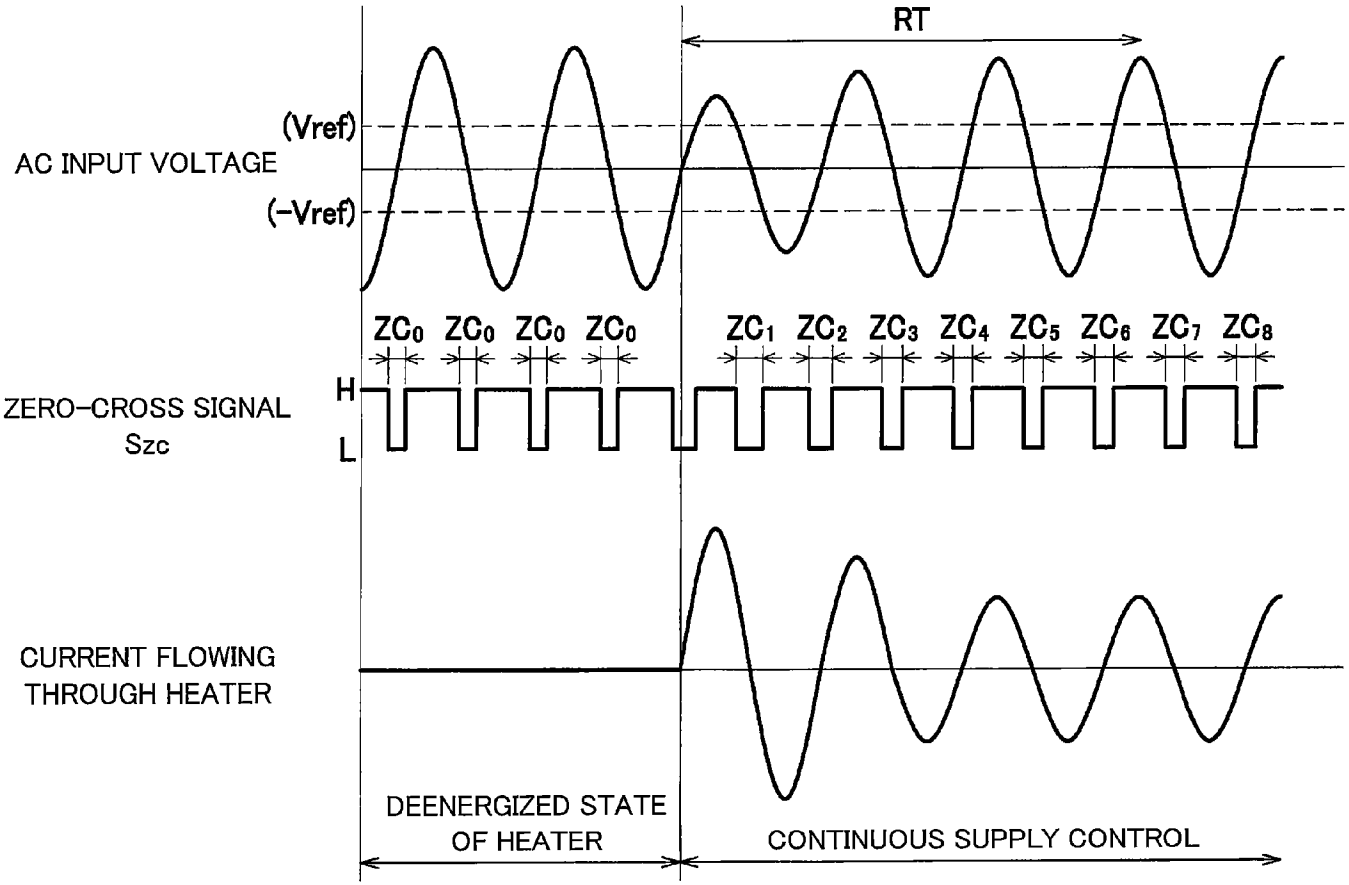
FIG. 6 is a timing chart of an AC input voltage, the zero-cross signal, and a current flowing into the heater in a case where a continuous control is commenced with respect to the heater deenergized.

As illustrated in FIG. 6, the zero-cross time width of the AC input voltage is a period of time during which an absolute value of the AC input voltage is no higher than a prescribed voltage value corresponding to the reference voltage Vref (the threshold value with respect to the divided DC voltage). The zero-cross time width corresponds to a time duration for which the zero-cross signal Szc is "low", as indicated by the period K2 in FIG. 5.

The reference zero-cross time width $ZC_0$ is a zero-cross time width in a state where the heater 31 is deenergized. In other words, the reference zero-cross time width $ZC_0$ is a zero-cross time width before the heater 31 is energized. The reference zero-cross time width $ZC_0$ is an example of the claimed "first zero-cross time width."

The zero-cross time width $ZC_1$ is a zero-cross time width immediately after the continuous supply control is started. In other words, the zero-cross time width $ZC_1$ is a period of time from a timing when the zero-cross signal Szc is changed from "high" to "low" for the first time after the continuous supply control is commenced to a timing when the zero-cross signal Szc is changed from "low" to "high" immediately after the first change from "high" to "low." The zero-cross time width $ZC_1$ is an example of the claimed "second zero-cross time width."

The recovery time RT is a time duration required for the AC input voltage to recover to the regular voltage level from a voltage level dropped owing to the continuous supply control. Specifically, the recovery time RT is a time duration from a timing when the continuous supply control is commenced to a timing when a difference value obtained by subtracting the zero-cross time width $ZC_{m+n}$ (i.e., the (m+n)-th zero-cross time width) from the zero-cross time width $ZC_m$ (i.e., the m-th zero-cross time width) becomes equal to or lower than a prescribed value. Note that the zero-cross time width $ZC_m$ is a period of time from a timing when the m-th change from "high" to "low" of the zero-cross signal Szc is made after the continuous supply control is started to a timing when the zero-cross signal Szc is changed from "low" to "high" immediately after the m-th change.

For acquiring the initial voltage dropping level and the recovery time RT, the ASIC 60 acquires from the inputted zero-cross signal Szc: the reference zero-cross time width $ZC_0$; and the successive zero-cross time widths $ZC_1$ to $ZC_k$ in each half-cycle (i.e., for each half-wave) of the AC input voltage, and stores them in the memory 63.

As illustrated in FIG. 6, during deenergization of the heater 31, the AC input voltage has a constant amplitude having a regular level, and the reference zero-cross time width $ZC_0$ is constant. Note that the regular level of the amplitude is equivalent to the regular voltage level.

On the other hand, immediately after the AC input voltage is applied to the heater 31, the AC input voltage is dropped or lowered and therefore its amplitude decreases. Hence, the AC input voltage varies more gently than during deenergization of the heater 31, so that the zero-cross time width $ZC_1$ is longer than the reference zero-cross time width $ZC_0$. After that, the zero-cross time width decreases as the amplitude of the AC input voltage gradually recovers toward the regular level, and then becomes equal to the reference zero-cross time width $ZC_0$. Note that, for the sake of convenience, the voltage level of the divided DC voltage described above is depicted in FIG. 6.

In the present embodiment, as an example, n is 1 (one). When a difference value obtained by subtracting the acquired zero-cross time width $ZC_{m+1}$ from the acquired zero-cross time width $ZC_m$ becomes no greater than the prescribed value, the ASIC 60 determines that the recovery of the AC input voltage to the regular voltage level has been completed. Subsequently, the ASIC 60 calculates, as the recovery time RT, a period of time from a timing when energization of the heater 31 is started to a timing when the above difference value becomes no greater than the prescribed value.

Here, the power supply mode and the power supply control performed thereunder will be described in detail. In the present embodiment, the power supply control is carried out in two stages, firstly a first control and thereafter a second control. The ASIC 60 performs the setting of the power supply mode by setting the first control and the second control as the power supply control for starting up the heater 31. The first control is a control with respect to a first period, and the second control is a control with respect to a second period subsequent to the first period.

The first period starts at a timing when energization of the heater 31 is commenced for starting up the same, and ends at a timing when a specific period of time elapses after the energization of the heater 31 is commenced.

The first period corresponds to a period of time from a timing when a temperature of the electrically resistive heating body of the heater 31 starts to rise to a timing when a resistance value of the heating body exceeds a reference resistance value. The resistance value of the heating body increases depending on the temperature rise of the heading body. In a case where the heating body has a low temperature, its resistance value is low. Hence, in a case where the heating body at the low temperature is energized, large current flows through the resistance heating body, whereupon an abrupt voltage fall of the AC input voltage occurs with a possibility higher than that at a high temperature.

The second period starts from a timing when the first period ends, and terminates at a timing when the temperature of the fixing roller 22 is elevated to a fixing temperature at which the fixing roller 22 can fix the developer image on the sheet of paper 5. Upon termination of the second period, the start-up (warm-up) of the heater 31 is completed.

The ASIC 60 sets the first and second controls on the basis of the initial voltage dropping level and the recovery time RT.

Specifically, when the initial voltage dropping level is lower than a predetermined threshold value, the ASIC 60 sets the first control to the continuous supply control (i.e., selects the continuous supply control as the first control) and also sets the second control to a wave number control (i.e., selects a wave number control as the second control). In the above case, the ASIC 60 performs the continuous supply control during the first period, and then performs the wave number control during the second period subsequent to the first period. In this case, a duty ratio used for the wave number control is set to a value D1, for example. Note that the wave number control is a control that energization of the heater 31 is managed every each half-cycle of AC input voltage to thereby adjust or set the duty ratio. For example, when the duty ratio is set to 25% in the wave number control, the heater 31 is energized only during a leading half-cycle of four consecutive half-cycles, but the heater 31 is not energized during the three remaining half-cycles.

On the other hand, when the initial voltage dropping level is equal to or greater than the predetermined threshold, the ASIC 60 sets the first control to a phase control (i.e., selects a phase control as the first control) and also sets the second control to the wave number control (i.e., selects the wave number control as the second control). In the above case, the ASIC 60 performs the phase control during the first period, and then performs the wave number control during the second period subsequent to the first period. In this case, in the wave number control, the duty ratio is set smaller as the recovery time RT is longer. Note that the phase control is a control in which energization of the heater is managed by controlling a phase angle to thereby adjust an amount of the power supply to the heater 31. In the present disclosure, the phase angle is an electric angle range to energize the heater 31, and is equivalent to or corresponds to the energizing period in half-cycle of the AC input voltage (i.e., a time durations indicated by the shaded regions in the first period in each of FIGS. 10C and 10D).

Figure 7A:
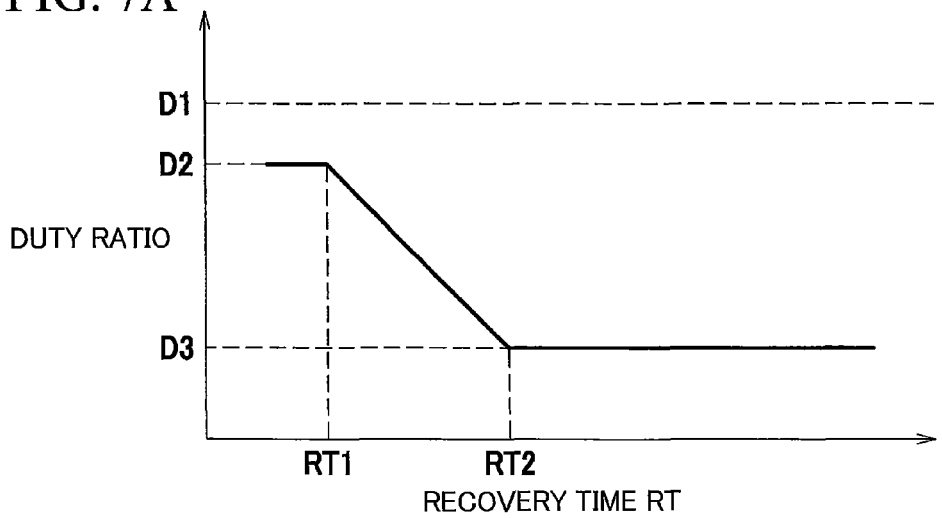
FIG. 7A is a map correlating a duty ratio and a recovery time.

As illustrated in FIG. 7A, the ASIC 60 stores in the memory 63 a map (or a table) in which the recovery time RT and the duty ratio in the wave number control are correlated with each other. The ASIC 60 refers to the map illustrated in FIG. 7A and selects relevant duty ratio on the basis of the recovery time RT. In the map illustrated in FIG. 7A, in a case where the recovery time RT is shorter than a prescribed period RT1, the duty ratio is set to an upper limit value D2. In a case where the recovery time RT is equal to or longer than the prescribed period RT1 and is equal to or shorter than a prescribed period RT2, the duty ratio is set smaller as the recovery time RT is longer. In a case where the recovery time RT is longer than the prescribed period RT2, the duty ratio is set to a lower limit value D3. In the example illustrated in FIG. 7A, the upper limit value D2 is lower than the value D1. Alternatively, the upper limit value D2 may be equal to the value D1.

Figure 7B:
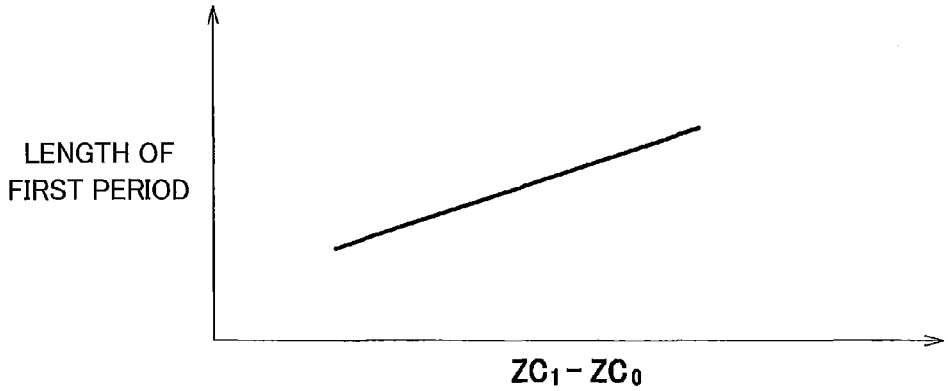
FIG. 7B is a map correlating an indication value ($ZC_1-ZC_0$) and a first period.

Further, as illustrated in FIG. 7B, the ASIC 60 stores in the memory 63 a map (or a table) in which correlated are the length of the first period (i.e., the specific period of time) and the indication value ($ZC_1-ZC_0$) corresponding to the initial voltage dropping level. The ASIC 60 determines the length of the first period on the basis of the indication value using the map illustrated in FIG. 7B. In the map illustrated in FIG. 7B, the greater the indication value is, the longer the first period (the specific period of time) is set. When the initial voltage dropping level is large, the first period is set long so that the switching from the first control to the second control can be made with the heating body having a high temperature. That is, the greater the initial voltage dropping level is, the higher the reference resistance value to the heater 31 is set, thereby enabling the heater 31 to have a high temperature when the first period ends.

Figure 7C:
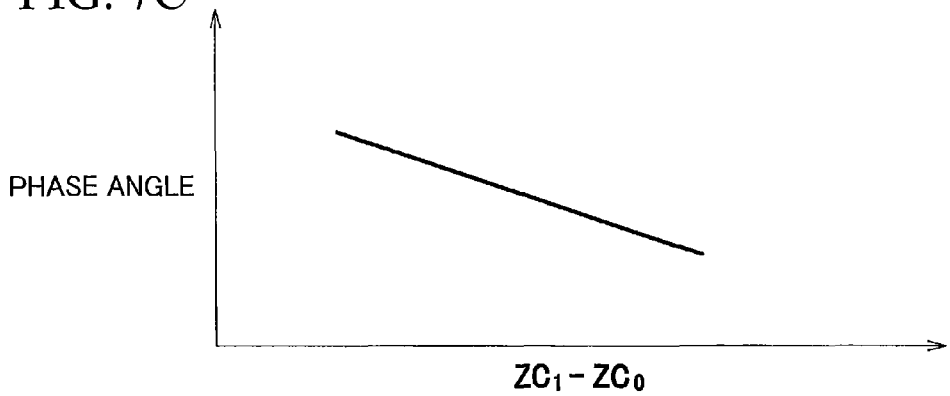
FIG. 7C is a map correlating the indication value ($ZC_1-ZC_0$) and a phase angle.

In addition, as illustrated in FIG. 7C, the ASIC 60 stores in the memory 63 a map (or a table) in which correlated are the indication value ($ZC_1-ZC_0$) and the phase angle (the electric angle range) in the phase control performed for the first period. The ASIC 60 determines the phase angle in the first period on the basis of the indication value using the map illustrated in FIG. 7C. In the map illustrated in FIG. 7C, the greater the indication value is, the smaller the phase angle is set. When the initial voltage dropping level is large, the phase angle is set small in the first period to thereby suppress the voltage dropping of the AC input voltage caused by large current flowing through the heater 31.

Note that the ASIC 60 stores a selected power supply mode (i.e., a combination of the first control for the first period and the second control for the second period) as setting information in the RAM of the memory 63. Hence, disconnection of the power plug of the laser printer 1 from the AC power source P causes the stored setting information to be deleted. Accordingly, when re-connection of the power plug to the AC power source P is made, the setting information is reset.

In the present embodiment, the power supply mode per se is stored as the setting information in the memory 63, but information stored as the setting information is not limited to the power supply mode. Information for setting the power supply control for starting up the heater 31 may be stored in the memory 63. For example, the initial voltage dropping level and the recovery time RT may be stored. Further, the setting information may be stored in a non-volatile memory. In this case, the setting information may be reset in an initial process performed in response to connection of the power plug to the AC power source P. Alternatively, the setting information may be reset in response to a command from the outside of the laser printer 1, such as a user's command.

Next, a control process implemented by the ASIC 60 will be described while referring to a flowchart illustrated in each of FIGS. 8 and 9.

Figure 8:
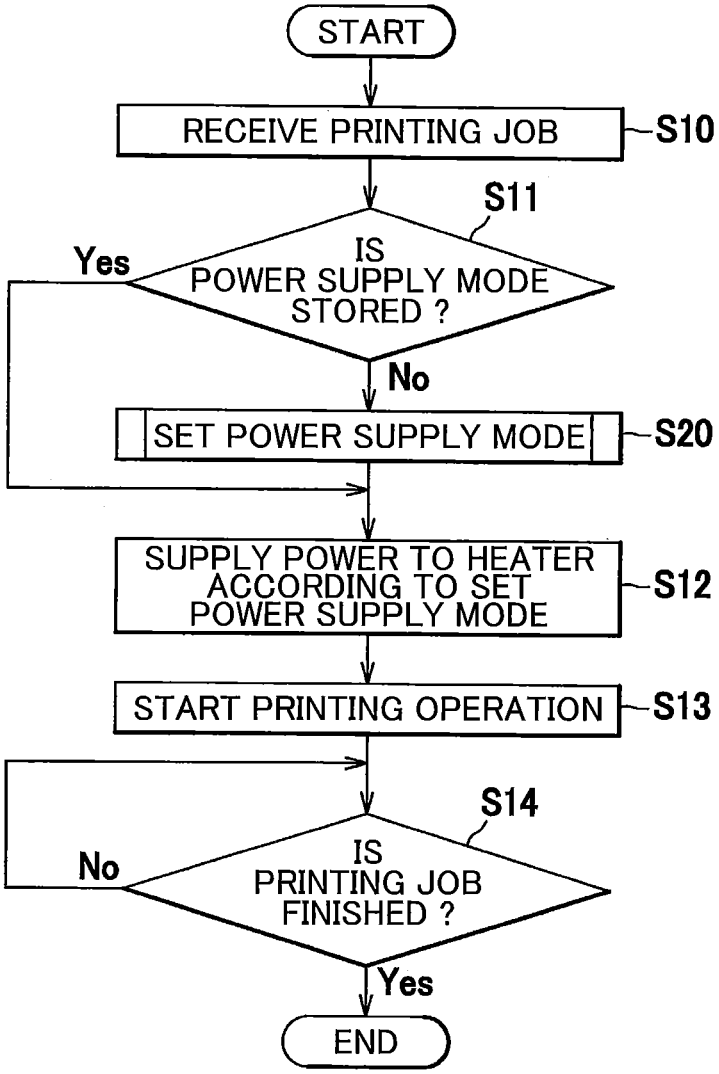
FIG. 8 is a flowchart illustrating an example of a control with respect to the heater.
Figure 9:
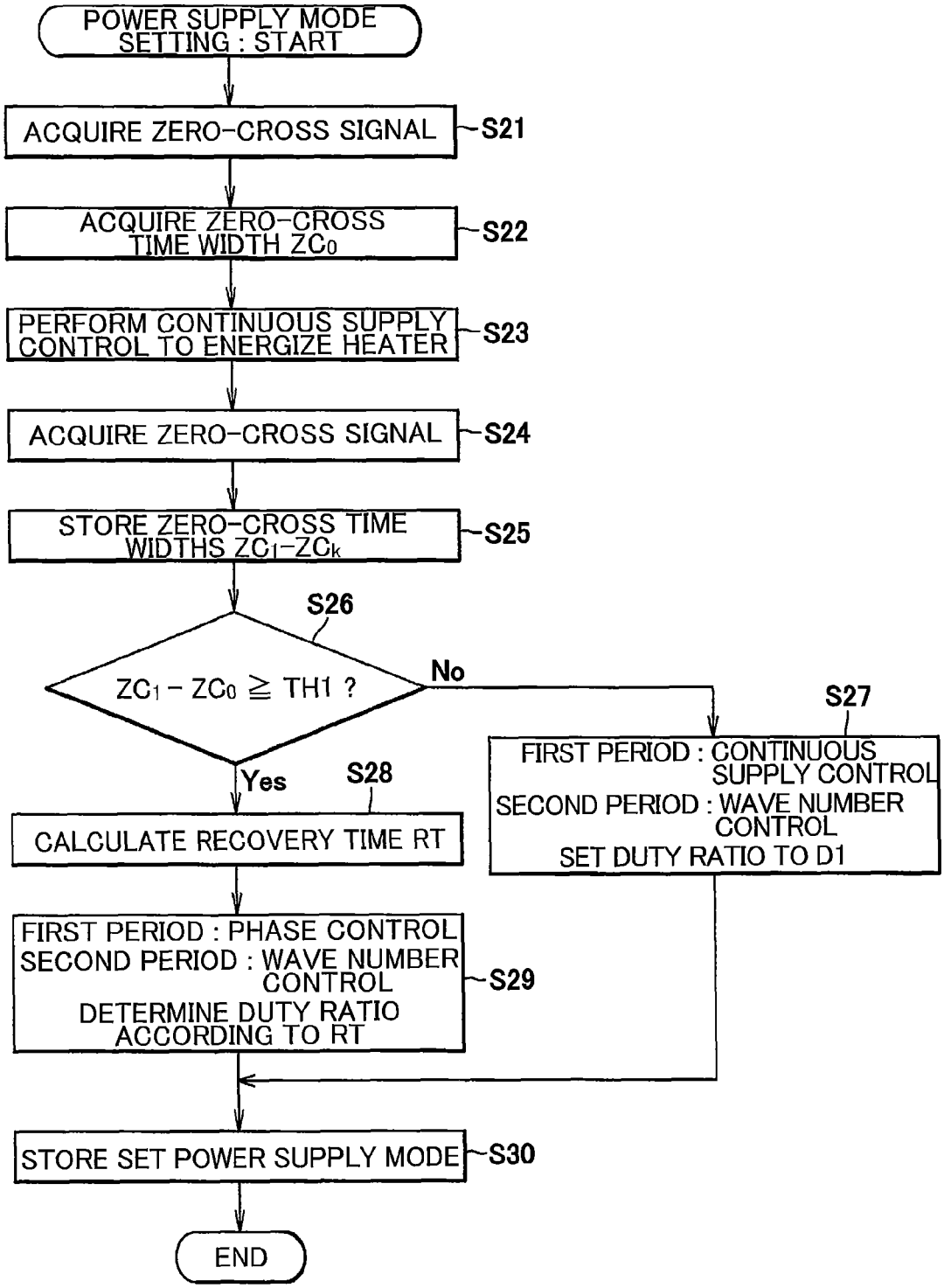
FIG. 9 is a flowchart illustrating the example of the control with respect to the heater.

As illustrated in FIG. 8, the ASIC 60 receives a printing job in S10. In response to receiving the printing job, the ASIC 60 determines in S11 whether or not the power supply mode (i.e., the setting information) is stored in the memory 63. When the power supply mode is not stored in the memory 63 (S11: No), the ASIC 60 sets the power supply mode in S20.

Here, the setting of the power supply mode in S20 will be described in detail with reference to FIG. 9.

In S21, in a state where the AC input voltage is still not applied to the heater 31 (i.e., the heater 31 remains deenergized), the ASIC 60 acquires or receives a zero-cross signal Szc. Then, in S22 the ASIC 60 acquires or calculates a reference zero-cross time width $ZC_0$ from the acquired zero-cross signal Szc, and stores the acquired reference zero-cross time width $ZC_0$ in the memory 63.

Subsequently, in S23 the ASIC 60 starts to perform the continuous supply control in which energization of the heater 31 is continued for the predetermined time period. In S24, in the energizing state, the ASIC 60 receives subsequently occurring zero-cross signal Szc. In S25, the ASIC 60 acquires or calculates, from the received zero-cross signal Sz, consecutive zero-cross time widths $ZC_1$ to $ZC_k$ within the predetermined time period, and stores the acquired zero-cross time widths $ZC_1$ to $ZC_k$ in the memory 63. Note that the energization to the heater 31 is halted after the predetermined time period elapses from the start of the continuous supply control.

After storing the acquired zero-cross time widths $ZC_1$ to $ZC_k$, the ASIC 60 determines in S26 whether or not an indication value obtained by subtracting the stored reference zero-cross time width $ZC_0$ from the stored zero-cross time width $ZC_1$ is equal to or greater than the predetermined threshold value TH1.

Figure 10A:
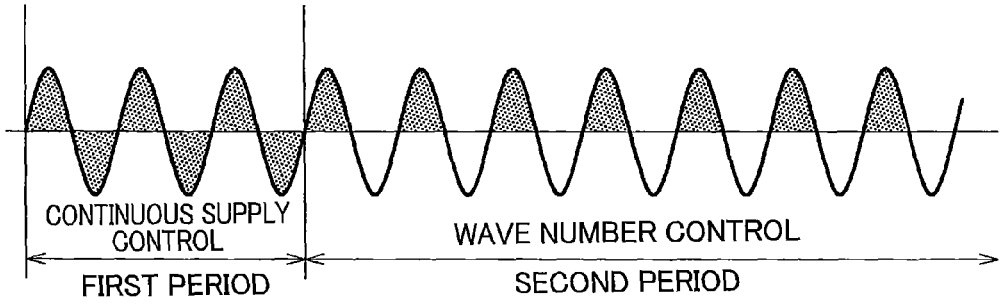
FIG. 10A is a graph illustrating an example of a power supply control performed during a period of time including the first period and a second period subsequent to the first period.

When the indication value ($ZC_1-ZC_0$) is not equal to or greater than the predetermined threshold value TH1 (S26: No), in S27 the ASIC 60 sets the first control to the continuous supply control and also sets the second control to the wave number control as illustrated in FIG. 10A. In the wave number control selected as the second control in S27, the duty ratio is set to the value D1. In each of FIGS. 10A to 10D, the shaded regions indicate time durations for which a current flows through the heater 31 (i.e., the energizing periods).

Figure 10B:
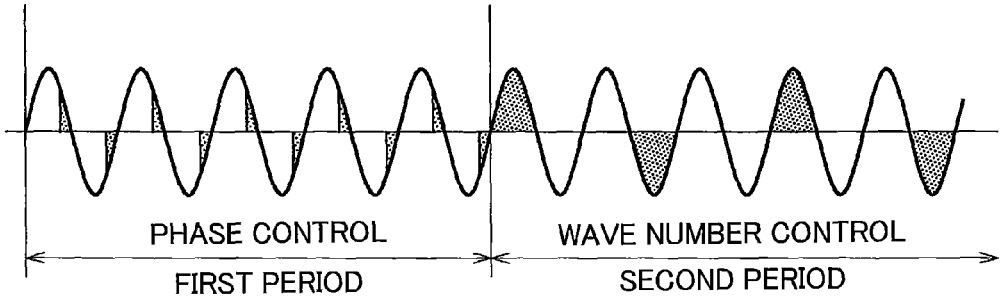
FIG. 10B is a graph illustrating an example of a power supply control performed during the period of time including the first period and the second period.
Figure 10C:
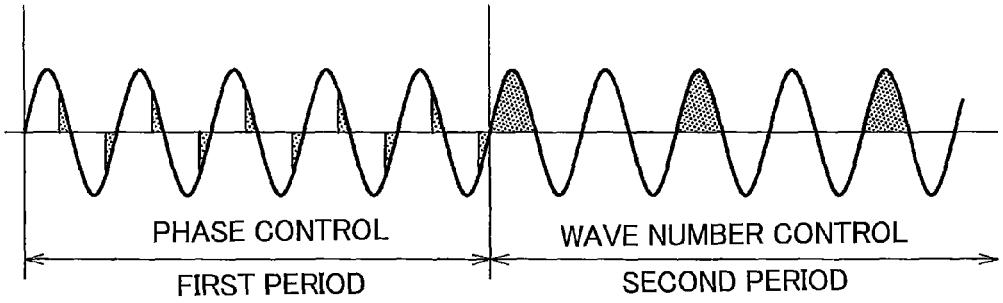
FIG. 10C is a graph illustrating an example of a power supply control performed during the period of time including the first period and the second period.

Referring back to FIG. 9, when the indication value is equal to or greater than the predetermined threshold value TH1 (S26: Yes), in S28 the ASIC 60 calculates the recovery time RT from the stored zero-cross time widths $ZC_1$ to $ZC_k$. Then, in S29 the ASIC 60 sets the first control to the phase control and also sets the second control to the wave number control. In the wave number control selected as the second control in S29, the duty ratio is set in accordance with the calculated recovery time RT. For example, when the calculated recovery time RT is short as illustrated in FIG. 10B, the wave number control with the duty ratio of 33% is selected with respect to the second period. In contrary, when the calculated recovery time RT is long as illustrated in FIG. 10C, the wave number control with the duty ratio of 25% is selected with respect to the second period.

Subsequently to the process in S27 or S29, in S30 the ASIC 60 stores the set power supply mode in the memory 63.

Referring back to FIG. 8, after performing the setting of the power supply mode in S20, the ASIC 60 starts the power supply control according to the set power supply mode to thereby re-start supplying power to the heater 31 (i.e., re-start to energize the heater 31) for starting up the same. As described above, in order to control the power supply to the heater 31, the ASIC 60 controls the fixing drive circuit 50 (specifically, the timing of the turning on of the triac 52) by changing the timing of the change from "low" to "high" of the trigger signal Stg.

Meanwhile, when the power supply mode (i.e., the setting information) is stored in the memory 63 (S11: Yes), in S12 the ASIC 60 starts the power supply control according to the stored power supply mode (i.e., the stored setting information) without performing the acquisition of the initial voltage dropping level and the recovery time RT, thereby starting to supply power to the heater 31 for starting up the same. As described above, a configuration can be employed that the ASIC 60 stores information for setting the power supply control as the setting information, instead of the power supply mode per se (i.e., the power supply control per se). In this case, in S12 the ASIC 60 sets the first and second controls on the basis of the stored information for setting the power supply control (for example, the initial voltage dropping level and the recovery time RT) and then starts the power supply control according to the set power supply mode (the set first and second controls).

Then, after the temperature of the fixing roller 22 reaches to the fixing temperature, the ASIC 60 starts the printing operation in S13. During the printing operation, the ASIC 60 performs the wave number control. In the wave number control performed during the printing operation, the ASIC 60 changes the duty ratio on the basis of the detection result of the thermistor 32 so that the feedback control is performed to thereby maintain the temperature of the fixing roller 22 at the fixing temperature. Then, when the received printing job is finished, the control process is ended.

According to the above embodiment, the controller 60 performs the continuous supply control in which the heater 31 is continuously energized. Further, the controller 60 acquires the initial voltage dropping level in the initial cycle of the AC input voltage immediately after the continuous supply control is performed, and the recovery time Rt required for the AC input voltage to recover to the regular voltage level. In a case where the initial voltage dropping level is large, a length of an electric path connecting the AC power source P to the heater 31 is presumed to be long. Meanwhile, in a case where the recovery time Rt is long, the capacity of the power source is presumed to be small. Taking the above into consideration, the controller 60 is configured to set the power supply control to control energization of the heater for starting up the heater 31 on the basis of the initial voltage dropping level and the recovery time Rt. With this configuration, the power supply to the heater 31 can be performed under an appropriate control according to an environment in which the laser printer 1 is used.

In the above-described embodiment, information (i.e., the indication value) corresponding to the initial voltage dropping level can be obtained from the reference zero-cross time width $ZC_0$ when the heater 31 is deenergized and a zero-cross time width $ZC_1$ immediately after the continuous supply control is started. Also, information corresponding to the recovery time can be obtained from the time duration from the timing when the continuous supply control is started to the timing when the difference value becomes equal to or lower than the prescribed value. The difference value is obtained by subtracting the zero-cross time width $ZC_{m+n}$ after the continuous supply control is started from the zero-cross time width $ZC_m$ after the continuous supply control is started. Further, the controller 60 is configured to set the power supply control to control energization of the heater 31 for starting up the heater 31 on the basis of the above information. Hence, the power supply to the heater 31 can be performed under an appropriate control according to an environment in which the laser printer 1 is used.

As described above, in the laser printer 1 according to the present embodiment, the power supply control for starting up the heater 31 is set on the basis of the initial voltage dropping level and the recovery time RT. Hence, even when an environment under which the laser printer 1 is used (for example, performance capability of an AC power source connected to the laser printer 1) is insufficient, a voltage dropping of the connected AC power source can suppressed, thereby restraining adverse influence from being exerted upon the laser printer 1 and other apparatuses connected to the same AC power source as the laser printer 1. On the other hand, when an environment under which the laser printer 1 is used (for example, performance capability of an AC power source connected to the laser printer 1) is sufficient, the continuous supply control is used for starting up the heater 31 to thereby rapidly start an image forming operation. That is, the laser printer 1 is capable of controlling power supply to the heater 31 in accordance with an environment in which the apparatus is used.

In the laser printer 1, the power supply control is carried out in two stages, firstly the first control to the first period and thereafter the second control to the second period. Hence, an appropriate control according to a condition of the temperature of the heater 31 can be performed. Further, when the initial voltage dropping level is not equal to or greater than the predetermined threshold value TH1, a duty ratio with which the wave number control is performed is smaller in the second period as the recovery time RT is longer. Therefore, the heater 31 is energized with the output suitable for the performance capability of the power source. Accordingly, the start-up of the heater 31 can be rapidly completed while suppressing the adverse influence exerted upon the laser printer 1 and other apparatuses.

Also, in the laser printer 1, the first period is set longer and the phase angle (the electric angle range) in the phase control is set smaller as the initial voltage dropping level is greater. Hence, the heater 31 is energized with the output suitable for the performance capability of the power source, thereby rapidly completing the start-up of the heater 31 while restraining the influence adversely exerted upon the laser printer 1 and other apparatuses.

While the description has been made in detail with reference to the above embodiment, it would be apparent to those skilled in the art that various changes and modifications may be made thereto.

Figure 10D:
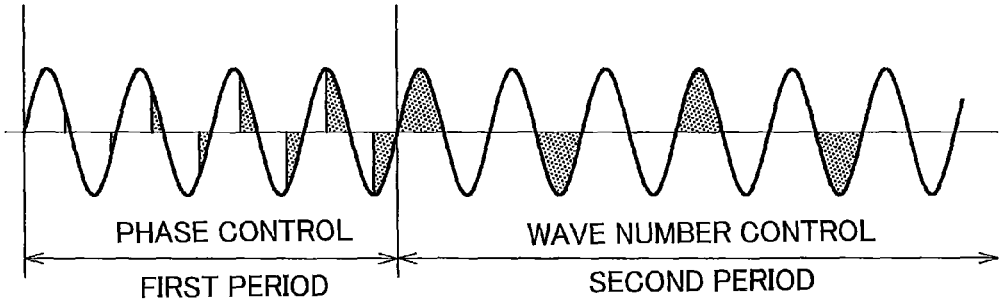
FIG. 10D is a graph illustrating an example of a power supply control performed during the period of time including the first period and the second period.

In the laser printer 1, the controller 60 may change the phase angle (i.e., the electric angle range) during the phase control as the first control. In this case, the phase angle may be changed within a range that is greater than an initial electric angle range set at a timing of starting the phase control and is equal to or smaller than a settable maximum electric angle range (i.e., an upper limit with respect to the electric angel range). For example, as illustrated in FIG. 10D, the phase angle used in the phase control may be gradually increased. With this control, the power supply to the heater 31 in the initial period of the phase control can be reduced, thereby suppressing the voltage dropping of the AC input voltage. Further, since the phase angle becomes greater as the temperature of the heater 31 rises, the start-up of the heater 31 can be rapidly completed.

In the above control, the phase angle is changed so as to be gradually increased. Alternatively, the phase angle may be changed so as to be increased stepwise. Further alternatively, the phase angle may be increased only once during the first period.

In the above-described embodiment, the recovery time RT is the time length. However, needless to say, the recovery time RT can be represented by values equivalent to the time length. For example, since the wave number of the AC input voltage is equivalent to the time length, the recovery time RT can be represented by the wave number of the AC input voltage.

The laser printer 1, i.e., the monochromatic laser printer has been described as an example of the image forming apparatus, but examples of the image forming apparatus may include a multi-color image forming apparatus, a copying machine, and a multi-functional peripheral. In the above-described embodiment, the surface of the photosensitive drum 17 is exposed to light by the laser beam. Alternatively, the surface of the photosensitive drum 17 may be exposed to light by an LED light. The sheet of paper 5 is employed as the sheet in the embodiment, but examples of the sheet may include an overhead projector sheet and other types of sheet. Further, in the above embodiment, the heater 31 generates heat, and applies the generated heat to the sheet of paper 5 using the hollow cylindrical shaped roller of the fixing roller 22. Alternatively, a heating belt may be used for applying the generated heat from the heater 31 to the sheet of paper 5.

What is claimed is:

1. An image forming apparatus comprising:

a process unit configured to form a developer image on a sheet;

a fixing unit including a heater configured to be applied with an AC voltage and to heat the sheet to fix the developer image to the sheet; and a controller configured to perform:

executing a continuous supply control in which the heater is continuously energized;

acquiring an initial voltage dropping level of the AC voltage and a recovery time during the executing the continuous supply control, the initial voltage dropping level being a voltage dropping level from a regular voltage level in an initial cycle of the AC voltage after the executing the continuous supply control is started, the recovery time being a time period of recovering the AC voltage to the regular voltage level from a voltage level dropped owing to the executing the continuous supply control; and setting a power supply control to control energization of the heater for starting up the heater on the basis of the acquired initial voltage dropping level and the acquired recovery time, wherein the power supply control includes a first control and a second control, the first control being used with respect to a first period from a timing when starting up the heater to a timing when a specific period of time elapses, the second control being used with respect to a second period starting from a timing when the first period ends, and wherein the setting the power supply control sets the first control and the second control on the basis of the acquired initial voltage dropping level and the acquired recovery time.

2. The image forming apparatus according to claim 1, wherein the controller is further configured to perform determining whether or not the initial voltage dropping level is equal to or greater than a predetermined threshold value, wherein, in response to determination that the initial voltage dropping level is not equal to or greater than the predetermined threshold value, the setting the power supply control sets the first control to the continuous supply control, and also sets the second control to a wave number control in which energization of the heater is managed every half-cycle of the AC voltage, wherein, in response to determination that the initial voltage dropping level is equal to or greater than the predetermined threshold value, the setting the power supply control sets the first control to a phase control in which energization of the heater is managed by controlling an electric angle range defining a period of time for which the heater is energized, and also sets the second control to the wave number control, and wherein the controller is further configured to perform:

executing the first control set by the setting the power supply control during the first period; and executing the second control set by the setting the power supply control during the second period subsequent to the first period.

3. The image forming apparatus according to claim 2, wherein in the setting the power supply control, the greater the initial voltage dropping level is, the smaller the electric angle range used in the phase control is set.

4. The image forming apparatus according to claim 2, wherein the controller is further configured to perform changing the electric angle range during the executing the phase control as the first control, and wherein the changing the electric angle range changes the electric angle range within a range that is greater than an initial electric angle range at a timing when the phase control is started and is equal to or smaller than a settable maximum electric angle range.

5. The image forming apparatus according to claim 1, wherein in the setting the power supply control, the greater the initial voltage dropping level is, the longer the first period is set.

6. The image forming apparatus according to claim 1, further comprising a memory for storing setting information including one of information about the power supply control set by the setting of the power supply control and information for setting the power supply control, wherein the controller is further configured to perform:

determining, prior to the acquiring, whether or not the setting information is stored in the memory; and executing, in response to determination that the setting information is stored, the power supply control on the basis of the stored setting information without performing the acquiring.

7. The image forming apparatus according to claim 6, wherein the controller is further configured to perform resetting the stored setting information in response to connecting to an external power source.

8. The image forming apparatus according to claim 1, wherein the acquiring acquires the initial voltage dropping level by comparing a first zero-cross time width acquired when the heater is deenergized with a second zero-cross time width acquired immediately after the executing the continuous supply control is started.

9. The image forming apparatus according to claim 1, wherein the acquiring acquires, as the recovery time, a time duration from a timing when the executing the continuous supply control is started to a timing when a difference value becomes equal to or lower than a prescribed value, the difference value being obtained by subtracting an (m+n)-th zero-cross time width after the executing the continuous supply control is started from an m-th zero-cross time width after the executing the continuous supply control is started.

10. An image forming apparatus comprising:

a process unit configured to form a developer image on a sheet;

a fixing unit including a heater configured to be applied with an AC voltage and to heat the sheet to fix the developer image to the sheet; and a controller configured to perform:

executing a continuous supply control in which the heater is continuously energized;

acquiring an initial voltage dropping level of the AC voltage and a recovery time during the executing the continuous supply control, the initial voltage dropping level being a voltage dropping level from a regular voltage level in an initial cycle of the AC voltage after the executing the continuous supply control is started, the recovery time being a time period of recovering the AC voltage to the regular voltage level from a voltage level dropped owing to the executing the continuous supply control; and setting a power supply control to control energization of the heater for starting up the heater on the basis of the acquired initial voltage dropping level and the acquired recover time, wherein the acquiring acquires the initial voltage dropping level by comparing a first zero-cross time width acquired when the heater is deenergized with a second zero-cross time width acquired immediately after the executing the continuous supply control is started.

11. The image forming apparatus according to claim 10, wherein the acquiring acquires, as the recovery time, a time duration from a timing when the executing the continuous supply control is started to a timing when a difference value becomes equal to or lower than a prescribed value, the difference value being obtained by subtracting an (m+n)-th zero-cross time width after the executing the continuous supply control is started from an m-th zero-cross time width after the executing the continuous supply control is started.

12. The image forming apparatus according to claim 10, further comprising a memory for storing setting information including one of information about the power supply control set by the setting of the power supply control and information for setting the power supply control, wherein the controller is further configured to perform:

determining, prior to the acquiring, whether or not the setting information is stored in the memory; and executing, in response to determination that the setting information is stored, the power supply control on the basis of the stored setting information without performing the acquiring.

13. The image forming apparatus according to claim 12, wherein the controller is further configured to perform resetting the stored setting information in response to connecting to an external power source.

14. The image forming apparatus according to claim 10, wherein the power supply control includes a first control and a second control, the first control being used with respect to a first period from a timing when starting up the heater to a timing when a specific period of time elapses, the second control being used with respect to a second period starting from a timing when the first period ends, and wherein the setting the power supply control sets the first control and the second control on the basis of the acquired initial voltage dropping level and the acquired recovery time.

15. The image forming apparatus according to claim 14, wherein the controller is further configured to perform determining whether or not the initial voltage dropping level is equal to or greater than a predetermined threshold value, wherein, in response to determination that the initial voltage dropping level is not equal to or greater than the predetermined threshold value, the setting the power supply control sets the first control to the continuous supply control, and also sets the second control to a wave number control in which energization of the heater is managed every half-cycle of the AC voltage, wherein, in response to determination that the initial voltage dropping level is equal to or greater than the predetermined threshold value, the setting the power supply control sets the first control to a phase control in which energization of the heater is managed by controlling an electric angle range defining a period of time for which the heater is energized, and also sets the second control to the wave number control, and wherein the controller is further configured to perform:

executing the first control set by the setting the power supply control during the first period; and executing the second control set by the setting the power supply control during the second period subsequent to the first period.

16. The image forming apparatus according to claim 14, wherein in the setting the power supply control, the greater the initial voltage dropping level is, the longer the first period is set.

17. An image forming apparatus comprising:

a process unit configured to form a developer image on a sheet;

a fixing unit including a heater configured to be applied with an AC voltage and to heat the sheet to fix the developer image to the sheet; and a controller configured to perform:

executing a continuous supply control in which the heater is continuously energized;

acquiring an initial voltage dropping level of the AC voltage and a recovery time during the executing the continuous supply control, the initial voltage dropping level being a voltage dropping level from a regular voltage level in an initial cycle of the AC voltage after the executing the continuous supply control is started, the recovery time being a time period of recovering the AC voltage to the regular voltage level from a voltage level dropped owing to the executing the continuous supply control; and setting a power supply control to control energization of the heater for starting up the heater on the basis of the acquired initial voltage dropping level and the acquired recovery time, wherein the acquiring acquires, as the recovery time, a time duration from a timing when the executing the continuous supply control is started to a timing when a difference value becomes equal to or lower than a prescribed value, the difference value being obtained by subtracting an (m+n)-th zero-cross time width after the executing the continuous supply control is started from an m-th zero-cross time width after the executing the continuous supply control is started.

18. The image forming apparatus according to claim 17, further comprising a memory for storing setting information including one of information about the power supply control set by the setting of the power supply control and information for setting the power supply control, wherein the controller is further configured to perform:

determining, prior to the acquiring, whether or not the setting information is stored in the memory; and executing, in response to determination that the setting information is stored, the power supply control on the basis of the stored setting information without performing the acquiring.

19. The image forming apparatus according to claim 18, wherein the controller is further configured to perform resetting the stored setting information in response to connecting to an external power source.

20. The image forming apparatus according to claim 17, wherein the power supply control includes a first control and a second control, the first control being used with respect to a first period from a timing when starting up the heater to a timing when a specific period of time elapses, the second control being used with respect to a second period starting from a timing when the first period ends, and wherein the setting the power supply control sets the first control and the second control on the basis of the acquired initial voltage dropping level and the acquired recovery time.

* * * * *